US006176420B1

(12) United States Patent
Sarson et al.

(10) Patent No.: US 6,176,420 B1
(45) Date of Patent: Jan. 23, 2001

(54) DISPOSABLE CUP WITH SPILL RESISTANT LID

(75) Inventors: George E. Sarson, 100 Queen Street North, Unit 1610, Kitchener, Ontario (CA), N2H 2H6; Daryl J. Howes-Jones, 152 Doon Valley Drive, Kitchener, Ontario (CA), N2P 2J5; Gregory John Kleynhans, Guelph (CA)

(73) Assignees: George E. Sarson; Daryl J. Howes-Jones, both of Kitchener (CA)

( * ) Notice: Under 35 U.S.C. 154(b), the term of this patent shall be extended for 0 days.

(21) Appl. No.: 09/588,284

(22) Filed: Jun. 7, 2000

Related U.S. Application Data

(60) Provisional application No. 60/137,703, filed on Jun. 7, 1999.

(51) Int. Cl.[7] ..... B65D 3/20

(52) U.S. Cl. ..... 229/128; 229/404; 229/902

(58) Field of Search ..... 229/116.1, 128, 229/131.1, 404, 902, 906.1

(56) References Cited

U.S. PATENT DOCUMENTS

| | | | | |
|---|---|---|---|---|
| 4,620,665 | * | 11/1986 | McSherry | 229/128 |
| 4,714,190 | * | 12/1987 | Morrocco | 229/404 |
| 4,915,235 | * | 4/1990 | Roosa | 229/902 |
| 5,061,501 | * | 10/1991 | Lowe | 229/128 |
| 5,676,306 | * | 10/1997 | Lankin et al. | 229/404 |
| 5,979,745 | * | 11/1999 | Surlina | 229/128 |

FOREIGN PATENT DOCUMENTS

| | | | | |
|---|---|---|---|---|
| 796271 | * | 6/1958 | (GB) | 229/128 |

* cited by examiner

*Primary Examiner*—Gary E. Elkins
(74) *Attorney, Agent, or Firm*—R. Craig Armstrong

(57) ABSTRACT

The disposable cup has a bottom insert, and a substantially truncated conical body having an integral lid and a cup opening. The lid is movable between a raised position and a closed position, possibly via a semi-closed position. The lid has a free edge, with a liquid passage opening allowing liquid passage when the lid is in said closed position. The lid is foldably joined to the body along an arcuate first score line. The lid further has second score lines arranged at respective ends of the free edge, the second score lines connecting the free edge and the first score line so that, when the lid is pushed towards the cup opening, the lid flips into a position inside the cup opening, the movement of the lid being substantially aided by the folding of the lid along the second score lines. The lid has a larger cross-dimension than the cross-dimension of the body at the closed position of the lid, so that, when the lid portion is pushed further into the body, the lid is bent into a convex shape to seal liquid access along the inside of the cup, and the lid is partly held in the cup in the closed position by frictional forces between the lid and the inside of the cup, and partly by the second score lines causing outer portions of the lid to bend to a substantially vertical position, thereby increasing the force holding the lid in the closed position.

35 Claims, 8 Drawing Sheets

DISPOSABLE CUP WITH SPILL RESISTANT LID

This application claims benefit of Provisional application 06/137,703, filed Jun. 7, 1999.

BACKGROUND OF THE INVENTION

1. Field of the Invention

This invention relates to two-piece disposable cups, suited for cold and warm beverages, peanuts, pop-corn and other solid foodstuffs, and especially to cups made of paper or paperboard.

2. Description of the Prior Art

Customary disposable cups usually comprise a bottom, a generally truncated conical body or liquid holding portion. This type of cup will be referred to as a two-piece cup. To prevent spilling, a separate lid can be applied over the opening of the cup. This type of cup will be referred to as a three-piece cup, since it has a body portion and a separate lid, as opposed to the cup according to the invention, which has a body portion with an integrated lid. Most standard cup designs thus use a separate replaceable lid to render the cup spill proof or spill resistant. Attempts have been made to incorporate a folding lid in a two-piece design, however, such designs have a number of functional problems. These, and other designs, use built in straws or side spout mechanisms or have a closure apparatus that requires a complex folding mechanisms, rendering them expensive and/or difficult to manufacture, difficult for consumers to use and/or difficult to stack.

A problem with two-piece cups is that they possess a wide open top, which is subject to spillage especially if used during sporting events, such as running events, or in any situation where there is an activity or where significant movement of the cup occurs. The problem has been overcome in the marketplace by the use of the three-piece cups, which involves placement of a detachable lid secured to the top of the cup. The three-piece design suffers from a variety of problems such as the inconvenience and time required to secure the lid to the cup, storage and transport, disposal problems if the lid were to blow off, and inconvenience in terms of controlling the flow of liquid because your nose hits the lid of the cup and potential spillage when liquids splash out of the opening.

Two-piece disposable cups with integral lids are shown in, for example, U.S. Pat. No. 5,960,987 (Solland et al.) and U.S. Pat. No. 4,620,665 (McSherry). Both of these designs have a deep ovate semicircular shaped lid portion of the die-cut cup, making the lid come to a rest position/sealing position in a semi-upright position along the opening edge of the cup, leaving the cup body portion cross-section substantially circular. Some type of locking mechanism on the upper edge of the cup is employed to hold the lid to the top edge of the cup opening.

SUMMARY OF THE INVENTION

A one-piece disposable cup according to the invention makes use of a lid which is formed from a semi-circular die-cut piece adjoined to the body portion of the cup. The general shape of the lid is circular, or slightly oval or shallow semi-circular. The lines of the scribe line arc forming the first fold line for the lid, adjacent the opening edge of the cup, are slightly flattened. The arc of the die-cut cup according to the invention is shallower than the corresponding arc of the known art. The ratio of a horizontal line, which joins the ends of the upper portion of the first fold line where it meets the edge of the cup, to the vertical distance from the center of the horizontal line to the lowest point of the arc of the first fold line, is approximately 4 for the cup, whilst the same ratio for the known art is between 1.5 and 2.5.

The cup according to the invention has two unique second fold lines along the upper edge of the arc which forms the lid. Each second fold line joins the first fold line near the upper edge of the first fold line and connects to the opening edge of the cup to form a triangular shape enclosed by the second fold line, the part of the primary fold line which runs from a first end of the second fold line to the edge of the cup, and the part of the edge of the lid which runs from the edge of the cup to a second end of the second fold line.

The cup lid closing mechanism functions in the following fashion: by a user exerting a slight pressure on the side of the lid, when the lid is in a vertical position, will cause the lid to change shape from convex (open and vertical) to concave shape, with a sudden click or flip towards the cup opening, causing the lid to fold over into the mouth of the body portion of the cup. The lid itself will move to a new stable position located inside the mouth, sealing the contents of the cup from splashing out from the cup. The lid's final closed position is near to the horizontal, within the body portion of the cup. This near horizontal closed position is caused by the shallower nature of the arc of the first fold line and the presence of the second fold lines. Upon closure of the lid, a double click (from each of the two second fold lines) occurs, allowing a more definitive and significant movement, flip or click of the lid to the closed position within the body portion of the cup.

The outer circumference of the lid of the cup is designed to be larger than the inner circumference of the body portion of the cup in the area of the intended closed position of the lid. When the lid clicks into position within the body portion of the cup, it must be pushed further slightly to reach the final resting position/closed position. This action may be performed by pushing on the lid itself, or by gently squeezing the sides of the cup together by applying pressure to the sides adjacent the two second fold lines. A combination of both actions is also possible. The final resting position is determined by the angle of the second fold lines relative the angle of the arc of the first fold line near the second fold lines. Near the resting location for the lid in the body portion of the cup there is a resistance to further movement of the lid into the cup. The resistance is caused by the pressure exerted by the increasingly smaller opening of the cup body on the lid, and by the resistance afforded by the presence of the second fold lines. The friction between the lid edge and the inside of the body of the cup renders the cup spill resistant and helps to secure the lid in its closed position within the body of the cup. There occurs a significant distortion of the lid when it reaches the resting position/closed position, due to the pressure the body exerts on the lid. The shape of the lid, in the closed position, is thus deformed into a parabolic shape within the body of the cup. This renders further rigidity to the lid and the cup as a whole. The described function of the lid inside the body of the cup is the primary locking mechanism for the lid, in its closed position. The locking of the lid in its closed position is preferably further enhanced by the precise shaping of the lid, so as to exaggerate the parabolic shape of the lid, when the lid is pushed into the body of the cup, and by the shape of the first fold lines, which causes the parabolic shaping of the lid when the lid is pushed to the closed position. The second fold lines function as a second locking mechanism, to hold or secure the lid in its closed position within the body of the cup.

When the lid is closed, the triangles formed by the first and second fold lines (as described earlier) are angled more vertically than adjoining portions of the lid. This orientation of the triangles cause the triangles to sit closer to the sides of the body of the cup than the rest of the lid, i.e. the surface of the triangles are nearly in the same plane as the general plane of the adjacent surface of the body. This feature makes it more difficult to open the lid, since the triangle portions of the lid will have to be bent back comparatively more when moving the lid back to its open position.

The lid thus attains a closed position within the cup, with a general plane of the lid near a horizontal plane, or with the movable edge of the lid slightly lower than the opposite folding edge of the lid. The opposing forces between the lid edge and the inside surface of the body of the cup renders enough friction to securely hold the lid within the body and render the cup spill resistant.

Furthermore, when the lid is in its closed position, there occurs a distortion of the body of the cup, from an oval shape, having a substantially flattened part where the lid attaches to the body portion, to a an ovate shape in the perpendicular direction (as seen from the top or bottom of the cup). This shaping in the closed position of the lid is due to the shape of the lid in the closed position. This feature renders the cup body significantly stronger compared to when the lid is not in the closed position. Also, the ovate shape of the body, when the lid is in the closed position, makes the cup very easy to hold and also leads the cup user to more easily find the opening of the cup lid. In the prior art designs, when the lid is in the closed position, the cup body retains a substantially circular cross-section shape, without the benefits described above of the ovate body shape of the cup according to the invention.

The opening arranged along the edge of the lid can be shaped in any suitable way to control the flow of liquid from the cup. The opening can further be shaped to accommodate straws and/or direct drinking from the cup body edge adjacent the opening, depending upon the application. The opening and the raised or protruding edge of the body portion of the cup, when the lid is in the closed position, combine to form a natural drinking edge or "funnel". Due to the interaction of the opening/lid and the body portion of the cup, the user of the cup can procure liquid without hitting his/her nose against the lid or the body of the cup, contributing to a more pleasant drinking experience. It is thus not necessary to lean the head backwards to drink the last drops from the cup according to the invention, merely tilting the cup further suffices.

With the lid in the closed position, the friction between the lid and the surface of the body portion of the cup, together with the secondary locking mechanism of the second fold lines, allows the lid to form a relatively tight seal between the lid and the cup, rendering the cup spill resistant. The only escape route for liquid is through the opening of the lid. The raised/upwardly protruding edges of the drinking lip also contributes to preventing spillage.

The primary locking mechanism of the lid in the closed position is, as described, the friction between the lid and the inside surface of the body of the cup, and the secondary locking mechanism being provided by the second fold lines of the lid. A series of preferable tertiary locking mechanisms can be employed to further secure the lid within the cup opening. The tertiary locking mechanisms may comprise locking edges within the side of the body of the cup, which edge catches the edge of the lid, when the lid is in the closed position. The locking edges are preferably arranged adjacent the second fold lines of the lid, to catch the part of the edge of the lid adjacent the second fold lines. Alternatively, the locking edges are formed to catch the edge portions of the lid adjacent the opening of the lid, or a combination of both arrangements of the locking edges. A glued-in locking edge might be used, instead or in combination with, locking edges formed directly in the body of the cup. A further possibility is to utilize one or more protuberances sticking out from the edge of the lid, which protuberances are insertable into slits arranged on the body portion of the cup, to lock the lid in the closed position. Still a further possibility of forming a locking edge, is to utilize at least one substantially horizontal slit in the body portion, whereby the portion of the body located above the slit or slits would be pushed inwards to create a locking edge for catching the edge of the lid, when the lid is in the closed position.

Due to the strength afforded to the cup by the second fold lines, when the lid is in the closed position, the cup body joint line, i.e. the substantially vertical edge along which the cup is joined together, can be placed directly adjacent a triangle formed by one of the second fold lines etc. (as described above). This location of the joint line (on the side of the cup), allows the unencumbered placement of lettering on the front of the cup, the back of the cup and on the lid, without having to compensate or align graphics or text for the glueing of the joint line (or any other joining technique used).

It is an object of the invention to mitigate and/or obviate the above mentioned disadvantages to provide a two-piece disposable cup suitable for holding cold and warm liquid beverages or other foodstuff. The cup has flip top lid which when pushed into position makes the cup spill resistant. This cup is intended to be used as a general purpose sport's cup suitable for many activities such as running events (i.e., marathons, triathlons, 10 km races etc.). The cup also has a general purpose market as a children's cup, airline cup, medicine cup or in any situation where a spill resistant cup is required. As such, the cup can be adapted to the fast food market and replace standard three-piece cup designs. The cup size and opening for fluids can be of various sizes or fitted with a straw for use in many applications. Additional uses are foreseen in the food industry in any application which requires spillage prevention, for example as a popcorn or peanut container, french fries container, etc. The opening in the lid would then be optimized to let a desired amount of contained matter out when pouring.

The present invention incorporates the use of a die-cut method which has been used on some paper products containers mainly for fast foods (i.e.,popcorn or chips). The die-cut mechanism for these products allows a portion of the carton to fold over to partially cover the contents to either keep in heat or protect the contents while it is sitting. The difficulty with this mechanism is that the lid is unstable and liquids cannot be placed in such containers because they are not leak proof. The present invention uses a simple die-cut mechanism and applies it directly to the beverage cup market.

The invention utilizes a two-piece cup design that eliminates the need for a separate lid thus eliminating the need for additional storage and disposal. This type of cup will be referred to as a two-piece cup, since it has a body portion and an integrated lid.

The cup according to the invention is easy to use. The invention uses a simple die-cut and quick fold mechanism. The lid is so designed that a reasonably secure and spill resistant cover results when the lid is pushed into a closed position in the cup opening. Securing the lid requires a simple push and does not require any significant manipulation.

The cup according to the invention is stackable after assembly into cup shape, and the unique "flip" or "click" which occurs when the lid is slightly pushed, allows the lid to flip into a semi-closed or closed position making total closure of the lid a simple operation. When the lid edge is moved fully into the mouth opening it clicks into position being held there by the nature of the deformation and by the lower edge of the mouthpiece member.

In one embodiment of the invention, the lid of the cup is so shaped that it sits tightly against the sides of the cup. The deformation of the lid and the sides of the cup helps secure the lid in the cup opening. The deformation thus formed also changes the cup profile to a more ovate shape which makes it more rigid and thus easier to hold or grasp. The lid to be is also deformed along the sides making it more rigid.

The mouthpiece for the cup forms a natural hollow between the lid and the edge of the cup which has been angled up. This allows the user a quick point of reference to find the opening, and it allows the liquid to pool temporarily in the space formed by the lid and sidewalls of the cup thus minimizing spillage or splashing when the cup is moved about. The construction also forms a convenient mouthpiece for the user. The hollow between the edge of the cup allows the user to angle the cup and drink without hitting their nose into the cup lid. For solid contents, the mouthpiece is used as a convenient pouring snout or funnel. Thus, the main differences between a cup according to the invention and cups of prior art are as follows:

The shape of the first fold line for the cup according to the invention can be described as somewhat shallow semi-circular. The lines of the first fold line arc adjacent the opening edge of the cup are slightly flattened. The prior art cups have wider and deeper and more generally uniform semi-circular to ovate fold line arcs.

The arc of the first fold line of the cup according to the invention is significantly shallower, compared to the fold line arc of the prior art. The ratio of a horizontal line, which joins the ends of the upper portion of the first fold line where it meets the edge of the cup, to the vertical distance from the center of the horizontal line to the lowest point of the arc of the first fold line, is approximately 4 for the cup according to the invention, whilst the same ratio for the known art is between 1.5 and 2.5.

The cup according to the invention has two second fold lines on the lid. No such fold lines are described in the prior art. The double click from both first and second fold lines allows for a more definitive and significant movement of the lid towards the closing position within the cup.

The deep ovate to semi-circular shape of the fold lines of the cups of the prior art causes the lids to close to a semi-upright position (30 to 45 degrees, typically). The lid comes to rest along the opening edge of the cup. In the cup according to the invention, the closed position of the lid is near the horizontal (when the cup is standing on a horizontal surface), caused by the shallower nature of the arc of the first fold line and the presence of the second fold lines.

In the prior art cups, when the lid comes to a closed position, it rests on top of or slightly within the opening edge of the cup body. A variety of locking mechanism are employed to hold the lid to the top edge of the cup opening. No significant insertion of the lid into the cup body occurs. In the cup according to the invention, the lid comes to a closed position well within the body of the cup, with the closed position of the lid near the vertical. The opposing forces between the lid edge and the inside of the cup body creates a friction fit, which in turn renders the cup according to the invention spill resistant and helps to secure the lid in its closed position within the cup body.

In the prior art, when the lid is in a closed position, the cup body maintains a substantially circular cross-section shape. In a cup according to the invention, the lid in a closed position causes a distortion of the cup body to an ovate shape, enhancing the rigidity of the cup and facilitates gripping the cup.

The cup according to the invention provides a mouthpiece, when the lid is in a closed position. This mouthpiece is funnel- or snout-shaped, and enhances the drinking properties of the cup as well as preventing spillage from the cup (raised edges).

The cup according to the invention further preferably provides third locking mechanisms (apart from the friction fit of the lid and the second fold lines) to secure the lid in the closed position.

Due to the strength afforded to the cup by the second fold lines, when the lid is in the closed position, the cup body joint line, i.e. the substantially vertical edge along which the cup is joined together, can be placed directly adjacent a triangle formed by one of the second fold lines etc. (as described above). This location of the joint line (on the side of the cup), allows the unencumbered placement of lettering on the front of the cup, the back of the cup and on the lid, without having to compensate or align graphics or text for the glueing of the joint line (or any other joining technique used). A further surface suitable for advertising print is the lid. Both sides may be used, only the top side of the lid being visible when the lid is in the closed position, of course.

BRIEF DESCRIPTION OF THE DRAWINGS

In order that the invention may be more clearly understood, the preferred embodiment thereof will now be described in detail by way of example, with reference to the accompanying drawings, in which:

FIG. 4B is a side view of the cup of FIG. 4, but with the addition of crescent shaped slits in the cup body, forming edges for holding the lid in the closed position when the material adjacent the crescent slits is pushed in, FIG. 4C is a detail sectioned side view of the crescent shaped slits in the cup body, forming edges for holding the lid in the closed position when the material adjacent the crescent slits is pushed in, FIG. 7B is a side view of the cup of FIG. 7, but with the addition of crescent shaped slits in the cup body, forming edges for holding the lid in the closed position when the material adjacent the crescent slits is pushed in.

DETAILED DESCRIPTION OF THE PREFERRED EMBODIMENT

Figure 12:
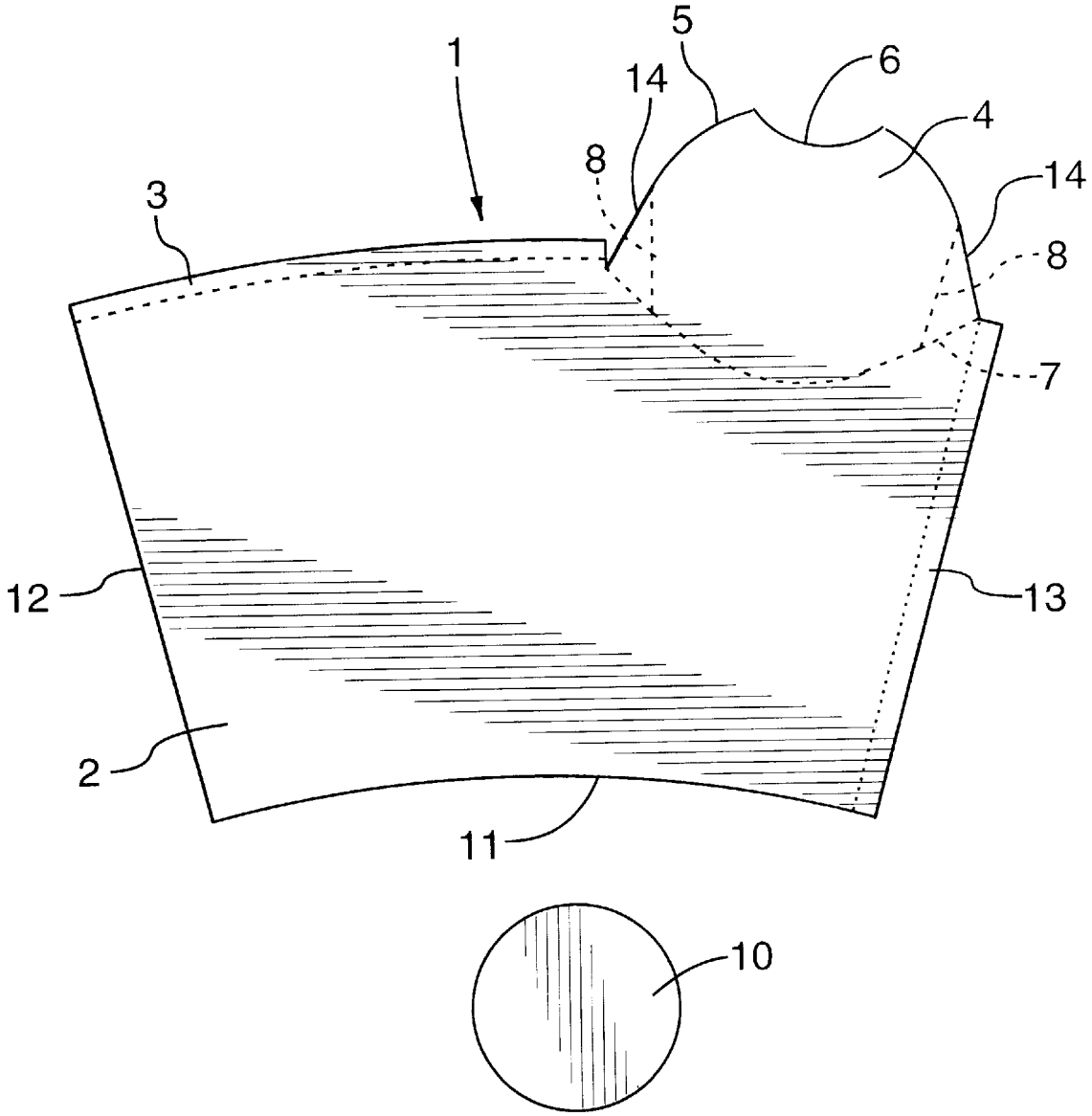
FIG. 12 is a top view of an unassembled cup according to the invention as it would appear cut or drawn onto suitable substrate material and before it is folded to form a cup.

FIG. 12 shows all the applicable components of the cup in a fold out position as it would be cut from a paperboard or similar material sheet. The cup 1 according to the invention has two parts, a cup body portion 2 with a lid 4 and a mouthpiece/lid securing member 9, and a bottom 10 of the cup. The body portion further has a first edge 12, a second edge 13, a top edge 3 and a bottom edge 11. The lid 4 has a free edge 5, which is curved and having a cross-sectional dimension which is larger than the diameter of the cup in the area where the lid is cooperating with the cup to form a seal (which will be described later), after the cup has been assembled. The free edge has end portions 14 where the free edge meets the body portion of the cup 2. The lid further has an opening formed along the free edge 5, to allow liquid to pass out from the cup, when the lid is in a closed position. The function of the cup in its assembled state will be described in more detail later. A first curved score line 7 completes the shape of the lid 4, together with the free edge 5 of the lid. The lid is thus foldable along the first score line, relative the cup body portion 2. Two second score lines 8 are arranged adjacent the end portions 14 of the free edge 5 of the lid 4. The second score lines allow the lid to click towards the opening of the cup, formed by the top edge 3 of the cup body portion 2, when a cup user pushes the lid from the raised position towards the cup opening.

The parts are assembled to form the completed product, a two-piece cup according to the invention. The first edge 12 and the second edge 13 of the cup body portion 2 are brought together and glued to form a truncated conical shaped cup. The bottom 10 of the cup is placed within the cup body, adjacent a lower edge 11 of the body portion, and fastened into position, for example by glueing. When the components of the cup are assembled, a two-piece cup is formed. FIGS. 1, 4, 5 and 9 show the cup 1 according to the invention in the assembled form, with the lid 4 in a raised position.

Figure 1:
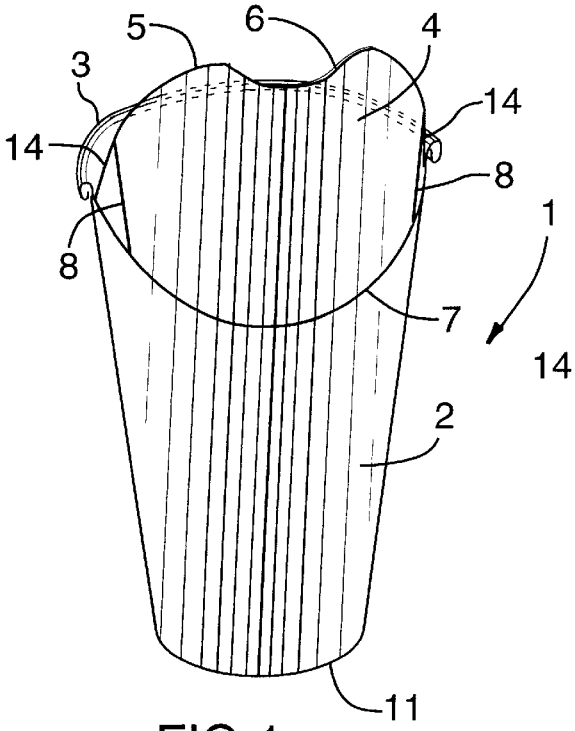
FIG. 1 is a perspective side view of an assembled cup according to the invention before the lid is pushed into its closed position, in this position the cup can be stacked for storage or transport.
Figure 2:
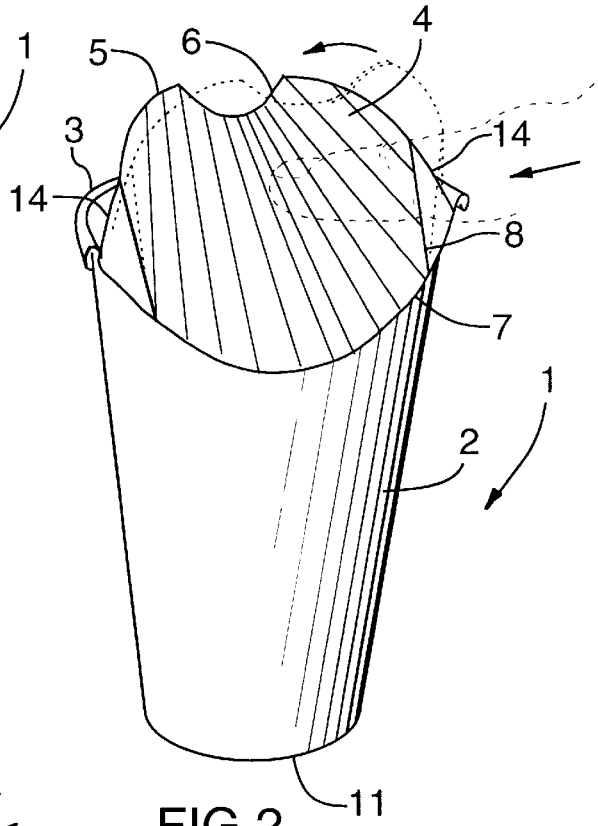
FIG. 2 is a perspective side view of the cup of FIG. 1 when the lid is initially pushed towards the cup opening.
Figure 3:
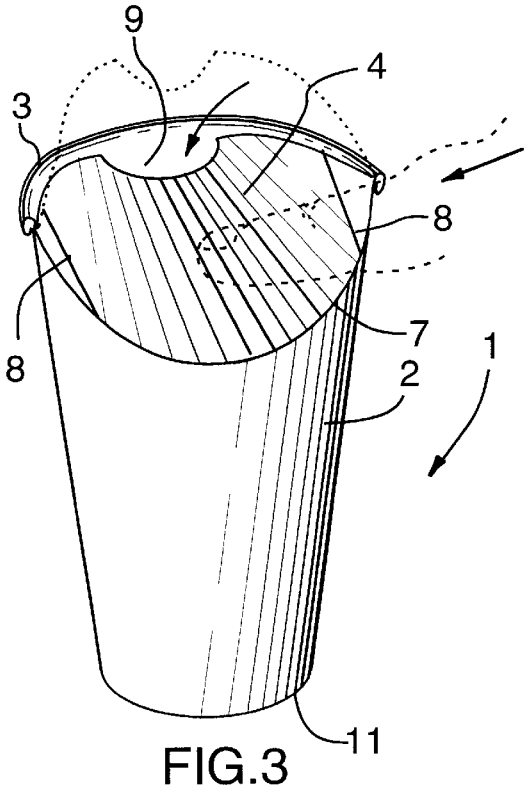
FIG. 3 is a perspective side view of the cup of FIG. 1 when the lid is initially pushed into its closed position.
Figure 3A:
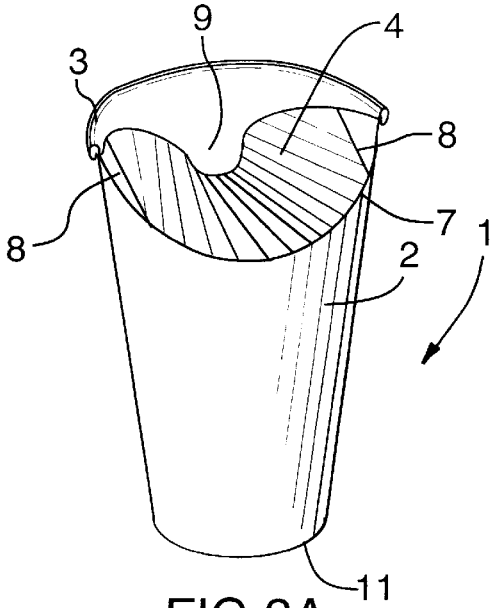
FIG. 3A is a perspective side view of an assembled cup according to the invention, showing the lid in the closed position.
Figure 4:
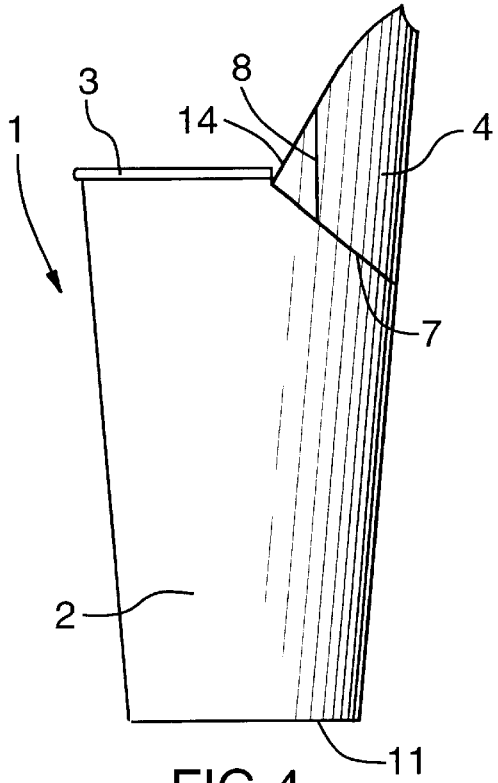
FIG. 4 is a side view of the cup of FIG. 1.
Figure 5:
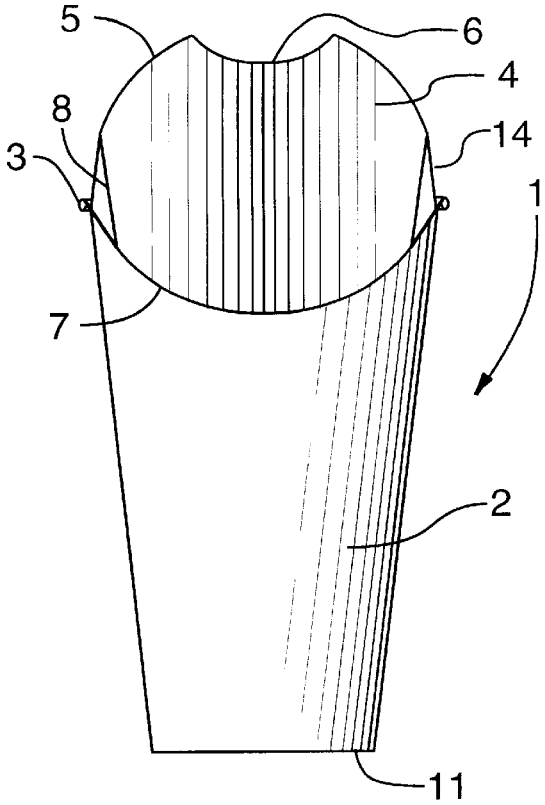
FIG. 5 is an end view of the cup of FIG. 1.
Figure 6:
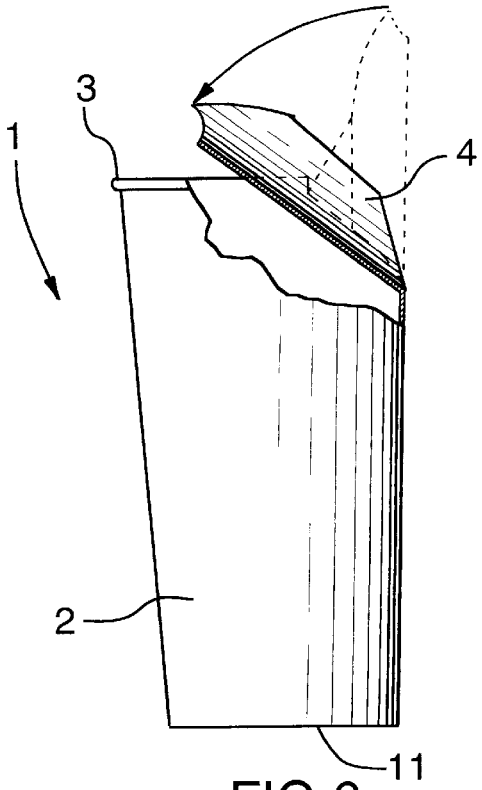
FIG. 6 is a partially sectioned side view of the cup of FIG. 2.

When a user of the cup pushes the lid 4 from the raised position towards the opening of the cup, as shown in FIGS. 2 and 6, the lid changes shape from convex (open and vertical) to concave shape, with a sudden click or flip towards the cup opening, causing the lid to fold over into the mouthpiece 9 of the body portion 2 of the cup 1. The lid itself will move to a new stable position located inside the mouthpiece, sealing the contents of the cup from exiting out from the cup. The lid's final closed position is preferably near to the horizontal, within the body portion of the cup. This near horizontal closed position is caused by the shallower nature of the arc of the first fold line and the presence of the second fold lines. In further embodiments of the invention, the arrangement of the second fold lines are altered to allow the lid to close in a position more upright compared to the horizontal position. This feature is used mainly with solid cup contents. Upon closure of the lid, a double click (from each of the two second fold lines) occurs, allowing a more definitive and significant movement, flip or click of the lid to the closed position within the body portion of the cup. For the lid 4 to reach the closed position, the user may push the lid slightly towards the bottom 10 of the cup 1, as shown in FIG. 3, to reach the final resting/closed position of the lid in the cup body, as shown in FIG. 3A.

Figure 7:
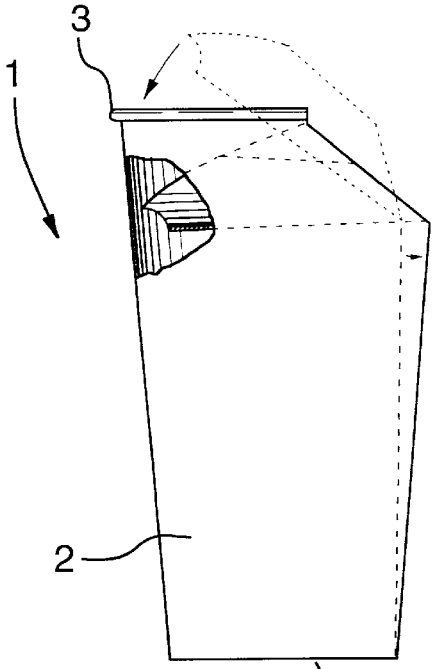
FIG. 7 is a partially sectioned side view of a cup according to the invention, showing the lid in the closed position, also showing the deformation of the cup body.

The lid is rendered foldable by the approximately semi-circular first score line 7, which is arranged, for example by a die-cut operation, on the side of the cup that occupies approximately one third of the circumference of the cup face. When the lid is pushed towards the mouthpiece 9 of the cup, the nature of the first score line 7, in conjunction with the action of the second score lines 8, and deformation of the cup wall created by the attached lid (FIG. 7) causes the lid to click or flip into a semi-closed or closed position. The process in mathematics is called a catastrophe event. From the semi-closed position the lid can then be pushed slightly further into the mouth of the cup, to a determined position marked by the bottom edge of the mouthpiece, as shown in FIG. 3A. The final position of the bottom edge of the mouthpiece in the mouth of the cup, is determined by the arrangement/location of the second score lines 8.

When the lid 4 is pushed further into the opening of the cup 1, the lid forms a tight fit to the sidewalls of the cup, as shown in FIGS. 3A, 8, 10 and 11. The inclusion of a mouthpiece 9 marks the line to which the cup lid is pushed. Once pushed beyond the mouthpiece, the lid clicks into position and is secured and is prevented from moving back by friction forces between the lid and the cup body portion, as described earlier. The lid is shaped so that, as it is pushed down into the cup, it becomes more constricted and pushes against the side of the cup. As the lid presses against the walls of the cup the consequent pressure causes a deformation of the cup from a circular to a ovate shape. The shape of the lid also deforms to form a parabolic or semicircular shape caused by the shape of the die-cut and the consequent pressure on the sidewalls of the cup within the opening of the cup mouth. The nature of the deformations renders the lid into a stronger structural shape and secures the lid to the inside of the cup. The shape of the lid is somewhat circular and slightly larger than the cup dimension at the intended closing position for the lid, and is shaped to deform the cup body into a unique ovate shape.

Figure 4A:
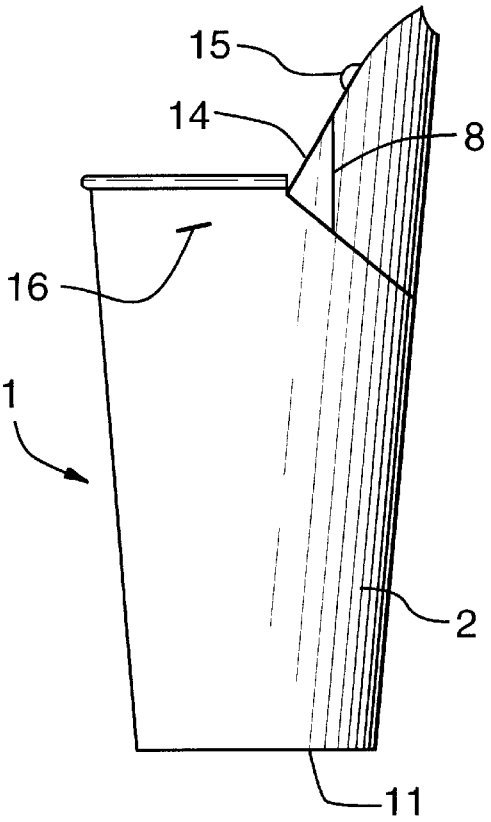
FIG. 4A is a side view of the cup of FIG. 4, but with the addition of protuberances on the lid for cooperation with slits in the cup body.
Figure 5A:
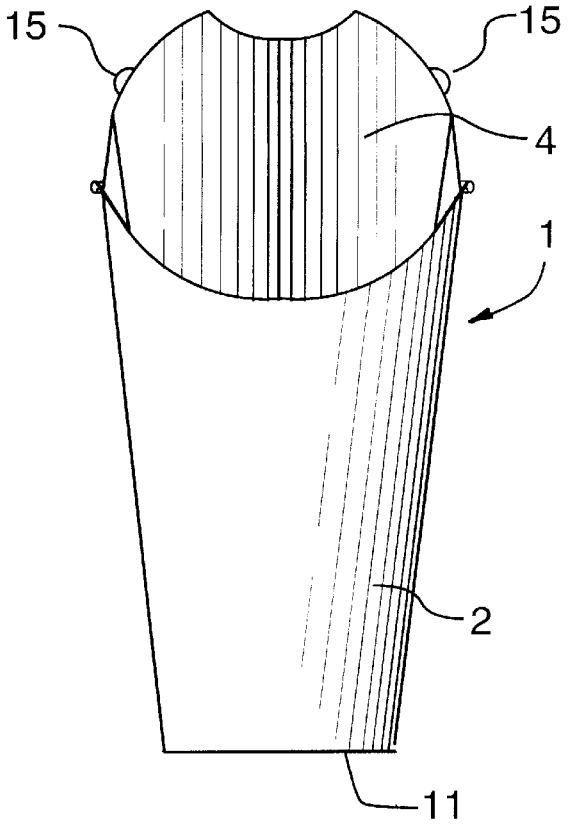
FIG. 5A is an end view of the cup of FIG. 5, but with the addition of protuberances on the lid for cooperation with slits in the cup body.
Figure 7A:
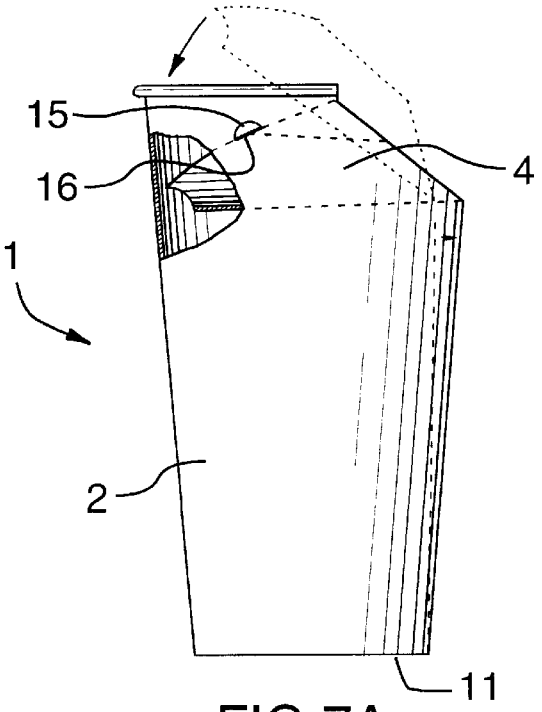
FIG. 7A is a side view of the cup of FIG. 7, but with the addition of protuberances on the lid for cooperation with slits in the cup body.
Figure 4B:
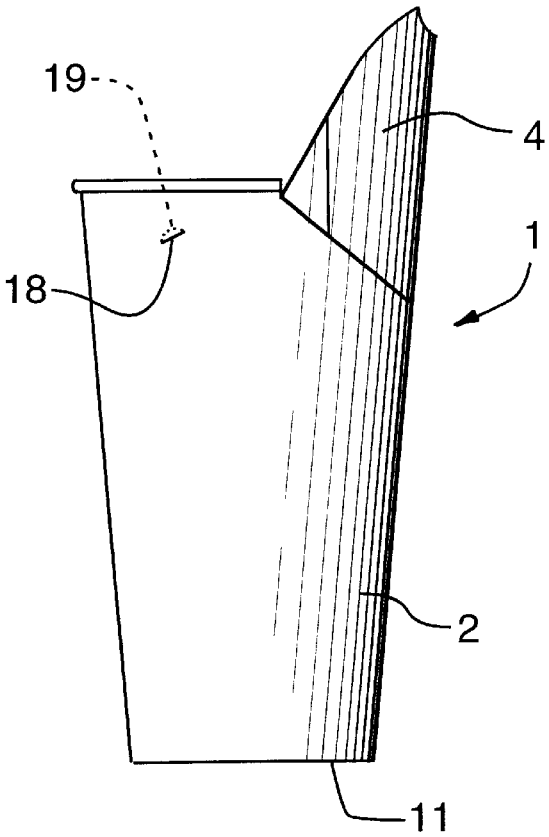
Figure 4C:
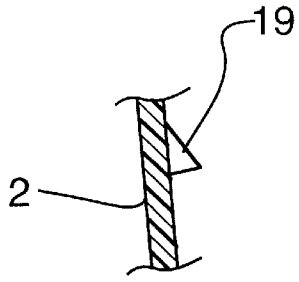
Figure 7B:
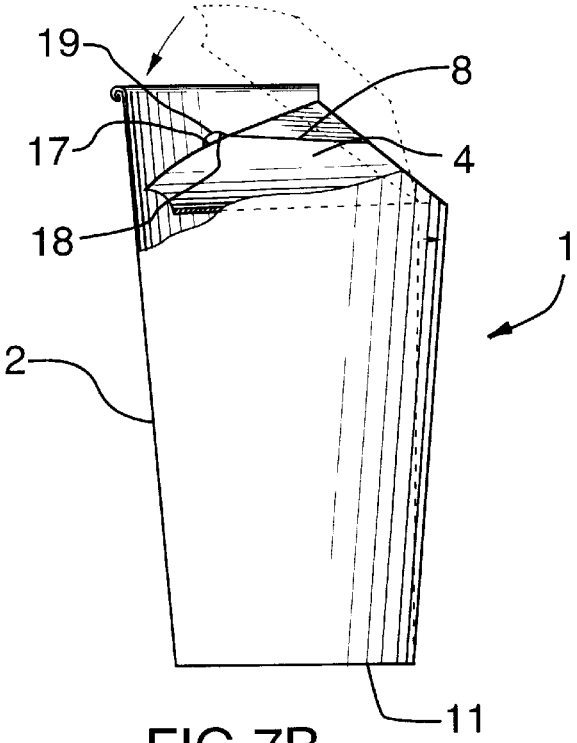
Figure 4E:
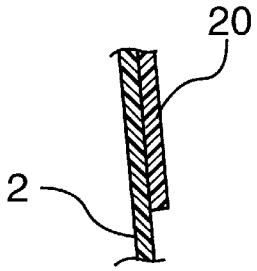
FIG. 4E is a detail sectioned side view of the glued-in member in the cup body mouthpiece, forming an edge for holding the lid in the closed position.
Figure 4D:
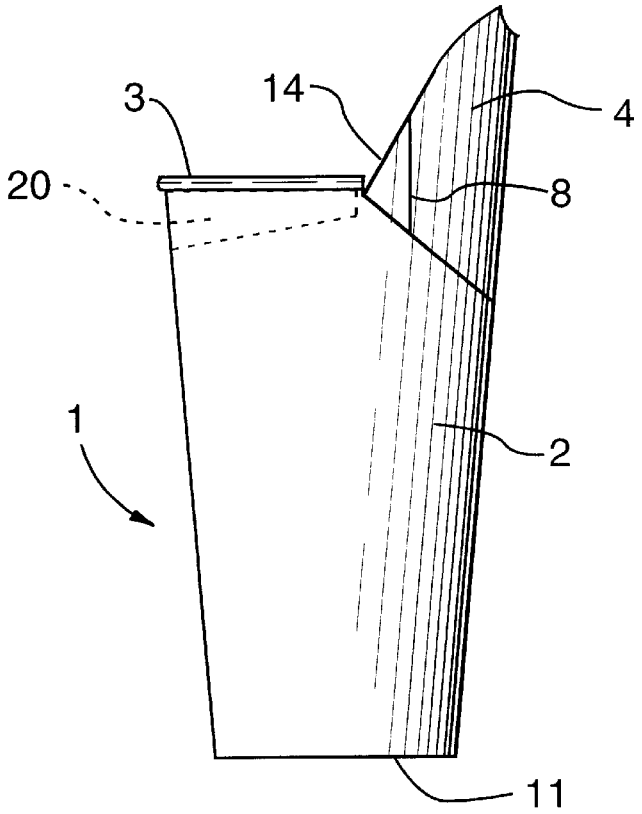
FIG. 4D is a side view of the cup of FIG. 4, but with the addition of a glued-in member in the cup body mouthpiece, forming an edge for holding the lid in the closed position.
Figure 7C:
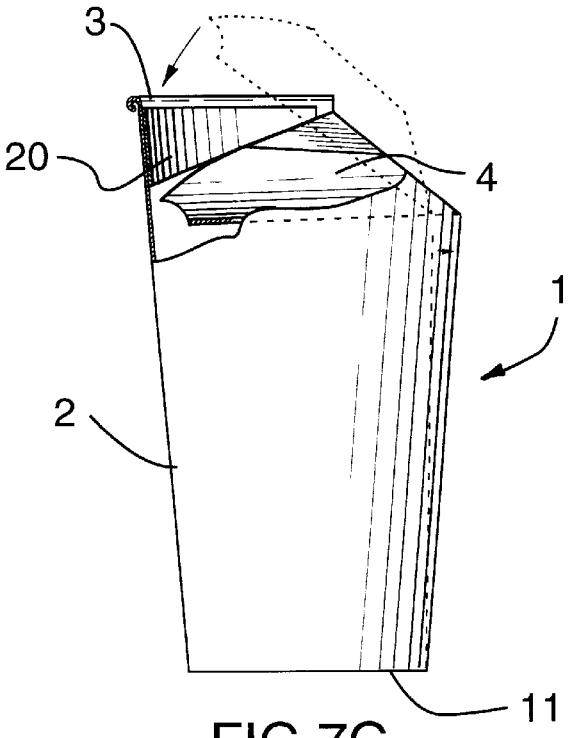
FIG. 7C is a side view of the cup of FIG. 7, but with the addition of a glued-in member in the cup body mouthpiece, forming an edge for holding the lid in the closed position.
Figure 4G:
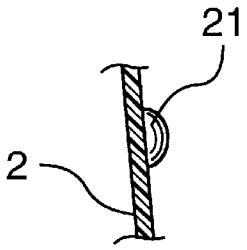
FIG. 4G is a detail sectioned side view of the dimple in the cup body, forming an edge for holding the lid in the closed position.
Figure 4F:
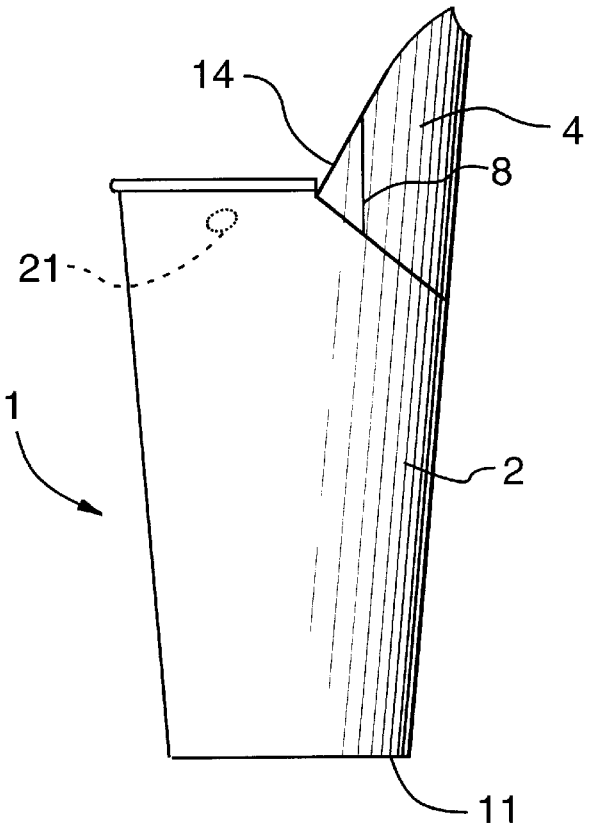
FIG. 4F is a side view of the cup of FIG. 4, but with the addition of inwardly protruding dimples in the cup body, forming edges for holding the lid in the closed position.
Figure 7D:
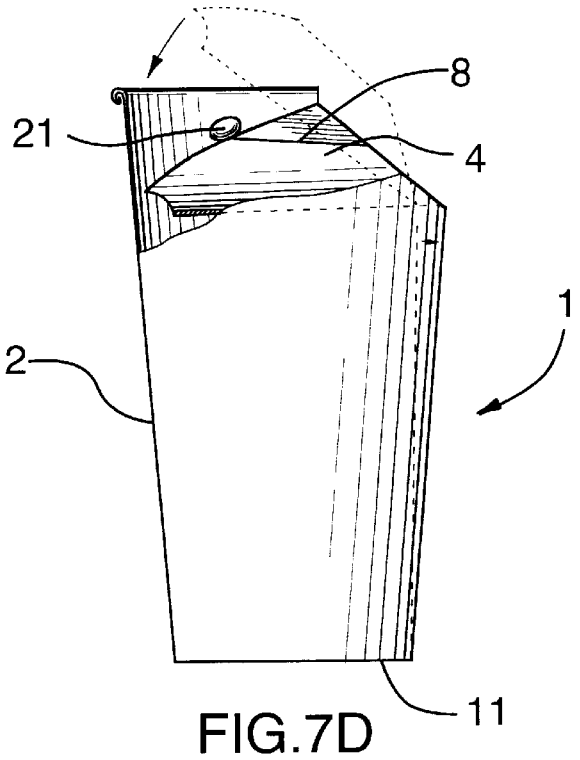
FIG. 7D is a side view of the cup of FIG. 7, but with the addition of inwardly protruding dimples in the cup body, forming edges for holding the lid in the closed position.
Figure 8:
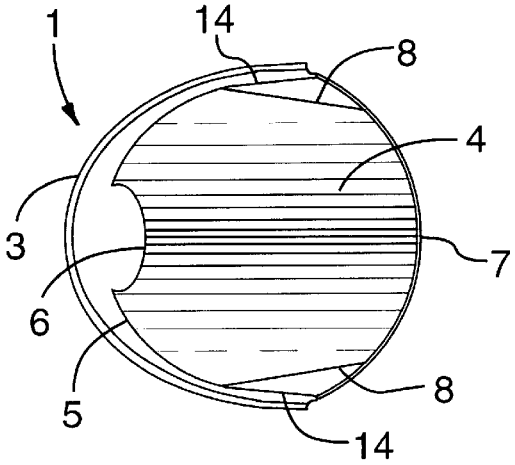
FIG. 8 is a top view of the cup of FIG. 7.
Figure 10:
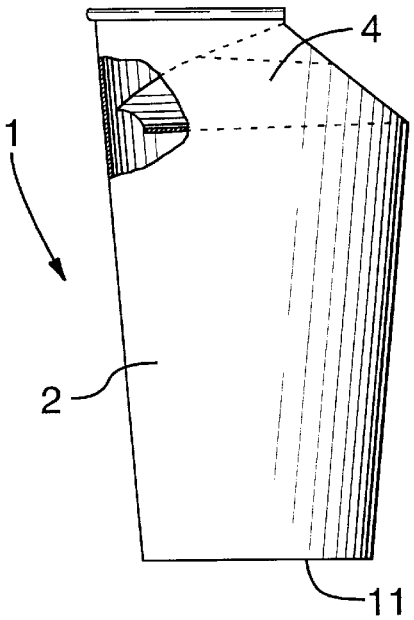
FIG. 10 is a partially sectioned side view of a cup according to the invention, showing the lid in the closed position.
Figure 11:
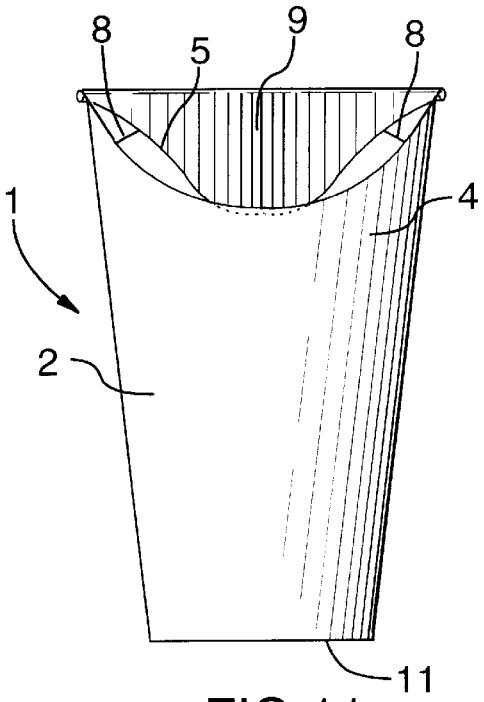
FIG. 11 is a side view of the cup of FIG. 3A.
Figure 9:
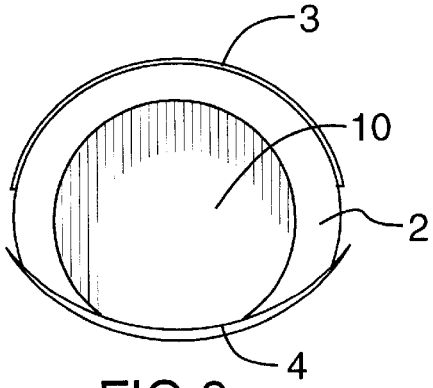
FIG. 9 is a top view of the cup of FIG. 1.

To further enhance the hold on the lid 4 in the closed position, a variety of locking mechanism may be employed. For example, one or more protuberances 15 may be arranged along the free edge 5 of the lid, to be insertable into correspondingly arranged slits 16 in the cup body, when the lid is in the closed position, see FIGS. 4A, 5A and 7A. Alternatively, a crescent-shaped slit 17 may be arranged in the cup body at a position corresponding to the lid 4 closed position, see FIGS. 4B and 7B. The area of the cup body located immediately above the crescent slit is pushed in slightly, towards the inside of the cup, to create an edge which holds the lid in the closed position, but which allows the lid to be pressed past the crescent slit into the closed position. A further alternative is shown in FIGS. 4D, 4E and 7C. A glued-in member 20 is arranged inside the cup body adjacent the mouthpiece 9, and is arranged so that a lower edge of the member forms an edge which holds the lid in the closed position, but which allows the lid to be pressed past the member into the closed position. Finally, still a further alternative is shown in FIGS. 4F, 4G and 7D. One or more dimples 21 are arranged to protrude inwards into the cup at locations adjacent the position of the lid in the closed position. The one or more dimples thus creates, which hold the lid in the closed position, but which allows the lid to be pressed past the dimples into the closed position.

The angle of the cup face adjacent the opening in the lid is raised and forms a mouthpiece 9 for convenient consumption of the contents of the cup.

The deformation of the cup causes an increase in rigidity of the cup body rendering it easier to hold.

A semicircular cut 6 is made in the lid so that it forms a pathway or opening for liquid, or any other cup content, when the lid is secured within the open face of the cup. The hole can be sized to various dimensions to control the flow of liquid or to hold a straw. For example, the opening may be in the shape of several slits allowing liquid to pass, but not ice cubes or other larger objects like orange slices etc.

Thus, a disposable cup according to the invention, comprises a bottom insert, and a body portion having an integral foldable lid portion. The foldable lid portion is joined to the body portion along an arcuate folding line, so that, when the lid portion is pushed towards the mouthpiece portion, the lid portion flips into a position inside the mouthpiece. The foldable lid portion has a larger cross-dimension than the cross-dimension of the body portion, at the intended closed position of the lid, so that, when the lid portion is pushed further past the mouthpiece portion into the body portion, the lid portion is bent further into a convex shape to seal liquid access along the inside of the mouthpiece portion and is secured inside the body portion by the action of the second score lines.

The dimensions of the cup are relative. The cup sizes can vary depending upon the application for the product.

It will be appreciated that the above description relates to the preferred embodiment by way of example only. Many variations on the invention will be obvious to those knowledgeable in the field, and such obvious variations are within the scope of the invention as described and claimed, whether or not expressly described. For example, the preferred embodiment has been described as a cup for liquids, but as previously mentioned other foodstuff can be held in a cup according to the invention after appropriate dimension changes. To achieve a non-horizontal closed position for the lid, the location of the second fold lines are altered as necessary. In this way, a sloping lid position may be attained for certain applications in which this is desirable. In addition, the shape or size of the lid may be altered to suit both the type of product contained in the cup and to the desired reliability of the seal between the lid and the inside body of the cup. In the case the lid is made smaller than the cross-section dimension of the inside of the body, the closure of the lid, i.e. the movement of the lid from the raised position to the closed position, will occur as one single event. No further push would be required to bring the lid into the closed position, as the frictional forces between the edge of the lid and the inside of the cup would be reduced. This particular embodiment of the invention would be used in instances where a tight frictional fit and consequent spillage would not be a factor, for instance when the cup is used to hold larger solids like peanuts.

What is claimed as the invention is:

1. A disposable cup, comprising:

a substantially truncated conical body and a bottom insert secured across what would otherwise be an open bottom of said body, said body having an integral lid and a cup opening, said lid being movable between a raised position and a closed position and having a free edge with a passage opening allowing passage of a controlled amount of cup contents when said lid is in said closed position, said lid being foldably joined to said body along an arcuate first fold line; wherein said lid further has second fold lines arranged adjacent respective ends of said free edge, said second score lines connecting said free edge and said first score line so that, when said lid is pushed from said raised position towards said cup opening, said lid flips into a position inside said cup opening, the movement of said lid being substantially aided by the folding of said lid along said second score lines and along said first fold line, said lid having a larger cross-dimension than the cross-dimension of said body at the closed position of said lid, so that, when said lid portion is pushed into said body, said lid is bent into a downward parabolic shape to seal cup content access along an inside of said cup, said lid being partly held in said cup in said closed position by frictional forces between said lid and said inside of said cup, and partly by said second score lines causing outer portions of said lid to bend to a generally vertical position, thereby increasing the force holding said lid in said closed position and resisting movement of said lid away from said closed position.

2. A disposable cup as recited in claim 1, wherein said lid, in said closed position, parts said cup body into an inside compartment for holding cup contents and an upper mouthpiece portion, said mouthpiece portion aiding pouring the cup contents out of said lid opening.

3. A disposable cup as recited in claim 2, wherein said lid is movable between said raised position and said closed position via a semi-closed position which the lid reaches after being pressed from said raised position, and wherein said lid external dimension is substantially larger than the internal dimension of said cup in an area adjacent said closed position of said lid, necessitating the lid to be further pressed towards said closed position to overcome frictional forces between said lid free edge and said inside of said cup, causing said cup body to assume an ovate cross-section shape.

4. A disposable cup as recited in claim 2, wherein said cup contents are liquid.

5. A disposable cup as recited in claim 2, wherein said cup contents are solid.

6. A disposable cup as recited in claim 2, wherein locking edges are arranged within said inside of said body of said cup, which edges catches said free edge of said lid, when said lid is in said closed position, to lock said lid in said closed position.

7. A disposable cup as recited in claim 6, wherein said locking edges are arranged adjacent said second fold lines of said lid, to catch a part of said free edge of said lid adjacent said second fold lines.

8. A disposable cup as recited in claim 6, wherein said locking edges are arranged adjacent said liquid passage opening, with said lid being in said closed position, to catch edge portions of said free edge of said lid adjacent said liquid passage opening of said lid.

9. A disposable cup as recited in claim 6, wherein said locking edges are arranged adjacent said second fold lines of said lid, to catch a part of said free edge of said lid adjacent said second fold lines, and wherein further locking edges are arranged adjacent said liquid passage opening, with said lid being in said closed position, to catch edge portions of said free edge of said lid adjacent said liquid passage opening of said lid.

10. A disposable cup as recited in claim 6, wherein said locking edges are glued-in on said inside of said cup.

11. A disposable cup as recited in claim 6, wherein said locking edges are formed as an integral part of said inside of said cup.

12. A disposable cup as recited in claim 6, wherein said locking edges are glued-in on said inside of said cup and wherein further locking edges are formed as an integral part of said inside of said cup.

13. A disposable cup as recited in claim 2, wherein one or more protuberances are arranged sticking out from said free edge of said lid, which protuberances are insertable into slits arranged on said body of said cup, to lock said lid in said closed position.

14. A disposable cup as recited in claim 2, wherein at least one substantially horizontal slit is arranged in said body, whereby a portion of said body located above said horizontal slit or slits is pushed inwards thereby creating a locking edge for catching said free edge of said lid, when the lid is in the closed position, to lock said lid in said closed position.

15. A disposable cup as recited in claim 3, wherein locking edges are arranged within said inside of said body of said cup, which edges catches said free edge of said lid, when said lid is in said closed position, to lock said lid in said closed position.

16. A disposable cup as recited in claim 15, wherein said locking edges are arranged adjacent said second fold lines of said lid, to catch a part of said free edge of said lid adjacent said second fold lines.

17. A disposable cup as recited in claim 15, wherein said locking edges are arranged adjacent said liquid passage opening, with said lid being in said closed position, to catch edge portions of said free edge of said lid adjacent said liquid passage opening of said lid.

18. A disposable cup as recited in claim 15, wherein said locking edges are arranged adjacent said second fold lines of said lid, to catch a part of said free edge of said lid adjacent said second fold lines, and wherein further locking edges are arranged adjacent said liquid passage opening, with said lid being in said closed position, to catch edge portions of said free edge of said lid adjacent said liquid passage opening of said lid.

19. A disposable cup as recited in claim 15, wherein said locking edges are glued-in on said inside of said cup.

20. A disposable cup as recited in claim 15, wherein said locking edges are formed as an integral part of said inside of said cup.

21. A disposable cup as recited in claim 15, wherein said locking edges are glued-in on said inside of said cup and wherein further locking edges are formed as an integral part of said inside of said cup.

22. A disposable cup as recited in claim 3, wherein one or more protuberances are arranged sticking out from said free edge of said lid, which protuberances are insertable into slits arranged on said body of said cup, to lock said lid in said closed position.

23. A disposable cup as recited in claim 3, wherein at least one substantially horizontal slit is arranged in said body, whereby a portion of said body located above said horizontal slit or slits is pushed inwards thereby creating a locking edge for catching said free edge of said lid, when the lid is in the closed position, to lock said lid in said closed position.

24. A disposable cup as recited in claim 2, wherein a ratio of a horizontal line, which joins ends of upper portions of said first fold line where it meets said opening of said cup, to a vertical distance from a center of said horizontal line to a lowest point of said arc of said first fold line, is approximately 3.5 to 5.5.

25. A disposable cup as recited in claim 3, wherein a ratio of a horizontal line, which joins ends of upper portions of said first fold line where it meets said opening of said cup, to a vertical distance from a center of said horizontal line to a lowest point of said arc of said first fold line, is approximately 3.5 to 5.5.

26. A disposable cup as recited in claim 2, wherein a cup body joint line is arranged directly adjacent one said second fold line, allowing unencumbered placement of lettering on a front of said cup, a back of said cup and on said lid.

27. A disposable cup as recited in claim 3, wherein a cup body joint line is arranged directly adjacent one said second fold line, allowing unencumbered placement of lettering on a front of said cup, a back of said cup and on said lid.

28. A disposable cup as recited in claim 27, wherein a ratio of a horizontal line, which joins ends of upper portions of said first fold line where it meets said opening of said cup, to a vertical distance from a center of said horizontal line to a lowest point of said arc of said first fold line, is approximately 3.5 to 5.5.

29. A disposable cup, comprising:

a substantially truncated conical body and a bottom insert secured across what would otherwise be an open bottom of said body, said body having an integral lid and a cup opening, said lid being movable between a raised position and a closed position and having a free edge with a passage opening allowing passage of a controlled amount of cup contents when said lid is in said closed position, said lid being foldably joined to said body along an arcuate first fold line;

wherein said lid further has second fold lines arranged adjacent respective ends of said free edge, said second score lines connecting said free edge and said first score line so that, when said lid is pushed from said raised position towards said cup opening, said lid flips into a position inside said cup opening, the movement of said lid being substantially aided by the folding of said lid along said second score lines and along said first fold line, said lid having a smaller cross-dimension than the cross-dimension of said body at the closed position of said lid, so that, when said lid portion is pushed into said body, said lid is bent into a downward parabolic shape to prevent cup content access along an inside of said cup, said lid being held in said cup in said closed position by said second score lines causing outer portions of said lid to bend to a generally vertical position, thereby providing the force holding said lid in said closed position and resisting movement of said lid away from said closed position.

30. A disposable cup as recited in claim 29, wherein said lid, in said closed position, parts said cup body into an inside compartment for holding cup contents and an upper mouthpiece portion, said mouthpiece portion aiding pouring the cup contents out of said lid opening.

31. A disposable cup as recited in claim 30, wherein said cup contents are solid.

32. A disposable cup as recited in claim 31, wherein locking edges are arranged within said inside of said body of said cup, which edges catches said free edge of said lid, when said lid is in said closed position, to lock said lid in said closed position.

33. A disposable cup as recited in claim 32, wherein said locking edges are glued-in on said inside of said cup.

34. A disposable cup as recited in claim 32, wherein said locking edges are formed as an integral part of said inside of said cup.

35. A disposable cup as recited in claim 32, wherein said locking edges are glued-in on said inside of said cup and wherein further locking edges are formed as an integral part of said inside of said cup.

* * * * *